US005411315A

United States Patent [19]

Greenwood

[11] Patent Number: 5,411,315

[45] Date of Patent: May 2, 1995

[54] INFANT BOUNCE CHAIR

[75] Inventor: Mark H. Greenwood, Arlington Heights, Ill.

[73] Assignee: Children On The Go, Inc., Wheeling, Ill.

[21] Appl. No.: 43,518

[22] Filed: Apr. 6, 1993

[51] Int. Cl.[6] ..... A47C 7/02

[52] U.S. Cl. ..... 297/440.24; 297/DIG. 11; 297/440.11; 297/452.13

[58] Field of Search ..... 297/285, 440.11, 440.1, 297/440.15, 440.16, 440.24, 452.13, DIG. 11, DIG. 2, 449, 452.18, 452.19, 452.2

[56] References Cited

U.S. PATENT DOCUMENTS

D. 282,791 3/1986 Lockett, III et al. .
2,848,040 8/1958 Chernivsky .
3,017,220 1/1962 Chernivsky .
3,110,519 11/1963 Chernivsky .
3,235,306 2/1966 Chernivsky .
3,687,092 8/1972 Manning ..... 297/DIG. 2 X
4,188,678 2/1980 Rawolle .
4,553,786 11/1985 Lockett, III et al. .
5,203,611 4/1993 Greenwood .
5,269,591 12/1993 Miga, Jr. et al. ..... 297/452.13

FOREIGN PATENT DOCUMENTS 2164249 3/1986 United Kingdom .

*Primary Examiner*—Kenneth J. Dorner
*Assistant Examiner*—Milton Nelson, Jr.
*Attorney, Agent, or Firm*—Olson & Hierl, Ltd.

[57] ABSTRACT

An infant chair structure having upper, lower and interconnecting main frame members, a leg support frame member, and an optional toy bar connector for joining the leg support frame member and the toy bar to desired locations along the upper frame member are provided. The chair structure has decentralized interconnections which avoid the problems of centralized connectors.

11 Claims, 2 Drawing Sheets

FIG. 9
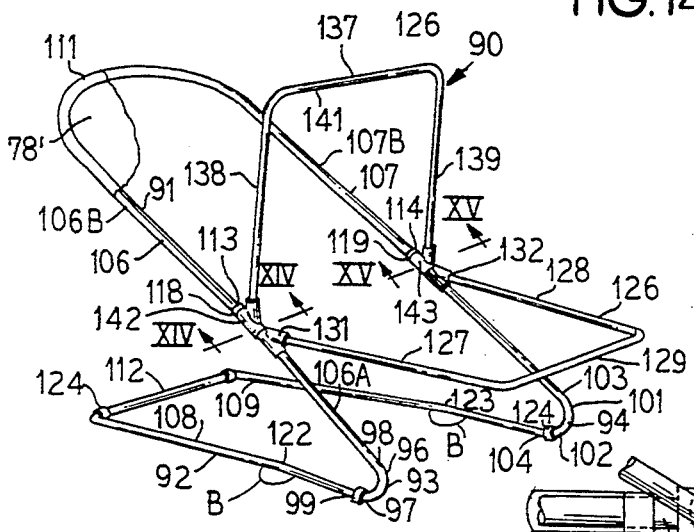
FIG. 14
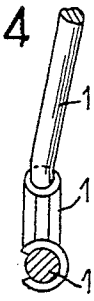
FIG. 15
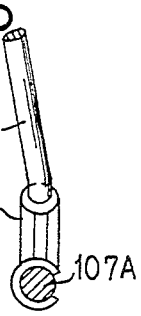
FIG. 12
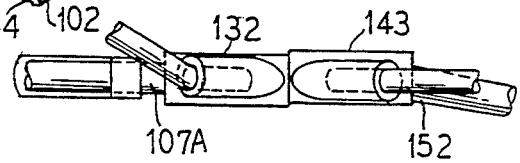
FIG. 10
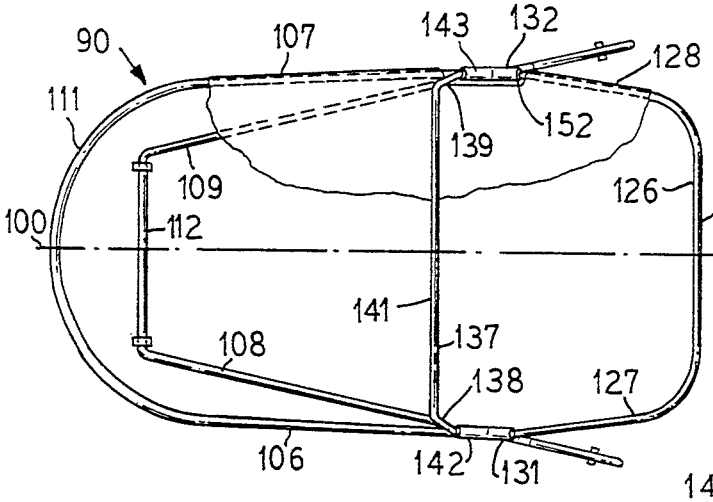
FIG. 11
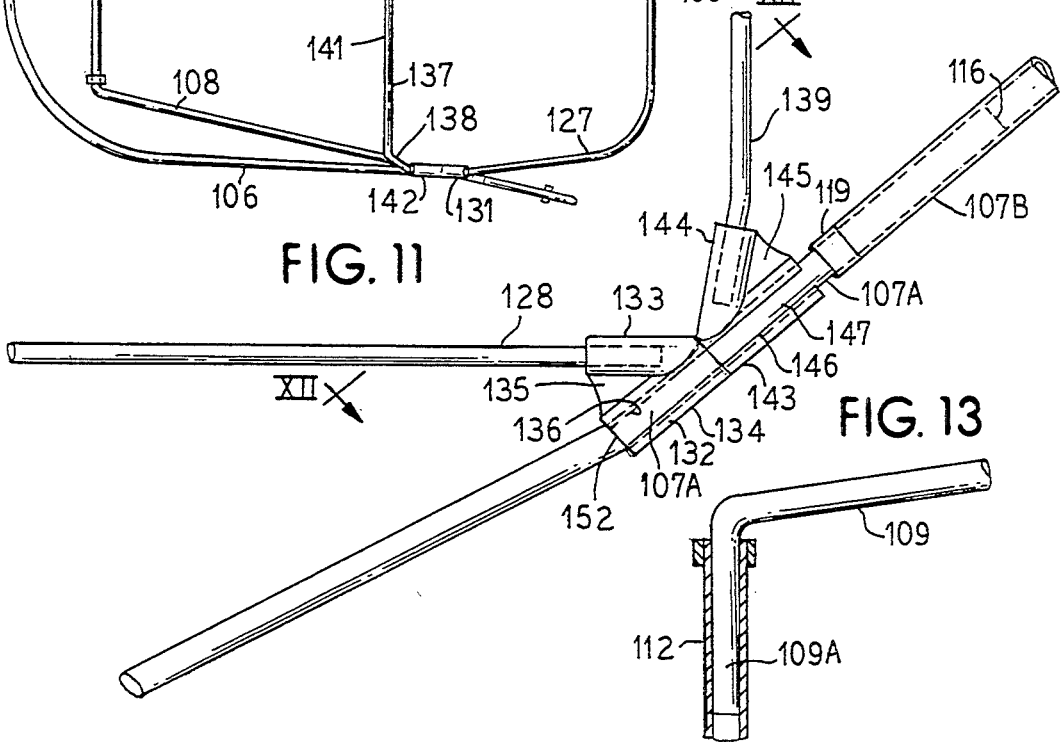
FIG. 13

INFANT BOUNCE CHAIR

FIELD OF THE INVENTION

This invention relates to an improved infant chair structure of the type having a leg and foot support extension.

BACKGROUND

Flexible infant chair structures of the so-called bouncer type which include generally U-configured, terminally interconnected upper and lower frame members, and which have a fabric member associated with the upper frame member for supporting an infant, are known; see, for example, Chernivsky U.S. Pat. Nos. 2,848,040; 3,017,220; 3,110,519 and 3,235,306.

Such a chair structure, however, had a serious disadvantage because the feet and lower legs of the infant hang downwards over the forward transversely extending edge of the fabric member. The weight of the lower limbs upon the edge of the fabric member was such that, after a period of occupancy in such a chair, it was common to observe that blood circulation in the region of the infant's knees was impaired.

To prevent such a result, various lower leg and foot support arrangements have been proposed including (a) locating an infant higher up upon the upper frame member, such as described in my U.S. patent application Ser. No. 779,717 filed Oct. 21, 1991 (now allowed); (b) providing an infant foot rest as disclosed by Rawolle U.S. Pat. No. 4,188,678; (c) providing a forwardly extending leg and foot supporting frame extension as disclosed in Crow U.K. published patent application No. 2,164,249A or Lockett III et al. U.S. Pat. No. 4,553,786; and the like.

Apparently because of user perceived advantages, such as stability (or low center of gravity), reduced tendency for lateral tipping, covering capacity for lower leg and foot support, achievement of a slightly different inclination angle for the leg supporting frame relative to the torso supporting frame, and the like, the leg supporting frame extension of arrangement (c) is attractive to many users.

However, both the Crow and Lockett III et al. chair structures suffer from various disadvantages. For one thing, both structures require that the leg frame be connected to the upper frame at the same location where the upper frame is connected to the lower frame which creates a potential weak point and which limits the possible structural configuration. For another thing, both prior chair structures are difficult to produce in pieces which are sized to fit into a commercially practical box adapted for packing, storing and shipment and which can be assembled into a safe chair structure in a simple and reliable manner preferably without tools.

The art needs a new and improved infant chair structure incorporating a leg and foot supporting frame means which overcomes these disadvantages.

SUMMARY OF THE INVENTION

The invention relates to an improved infant chair structure wherein a main frame incorporates peripheral upper, lower and connecting frame members and wherein the upper frame member is connected to a leg support frame member and to an optional but preferred toy bar member.

The main frame members and the connecting frame members can be disassembled into compact component parts for shipping and storage yet can be assembled to provide a safe structure. The locations of component connection are decentralized. The upper frame and leg support frame members are provided with a chair covering.

More particularly, in a chair structure of this invention, selected transversely opposed discontinuities (or separations) are provided in upper and/or lower U-configured main frame members and these discontinuities are interconnected together by sleeve type interconnections. Rear ends of a U-configured leg support frame member and of an optional U-configured toy bar are each independently connected to respective opposite lower side leg portions of the upper U-shaped frame member by V-type connectors. A fabric-type of chair covering structure is slidably and removably engagable with each of the upper portions of the upper frame member and the leg support frame member.

Thus, usage of an opposed pair of universal type of frame associated connector means requiring a single central component connection location is completely avoided.

The decentralized connections achieved in the present chair structure provide added structural integrity. Configuration versatility is also achieved.

New and improved compact, disassembled, but easily and simply assembled, frame components are provided.

Further, a chair structure of this invention can be provided wherein the spatial position and orientation of the leg support frame member can be varied, if desired. Also, the toy bar, if employed, can similarly be varied, if desired, relative to the upper frame member.

For ease in achieving chair disassembly capacity into compact component parts which can be stored, shipped or the like, yet which can be assembled without tools into a stable, reliable, safe chair, the respective individual U-configured component main frame members are provided in parts that are engagable with one another with decentralized sleeve-type and V-type connector means.

It is a feature of the present invention that, if desired, some decentralized sites of frame member connection locations can be fixed at the time of chair manufacture.

Even when connection locations are chosen or fixed at the time of chair manufacture, the inventive chair structure makes possible safe and stable individual chair arrangements and configurations that could not be achieved when, as in the prior art, a single opposed pair of centralized frame connection locations was employed.

It is a further feature of the present invention that the herein provided decentralized connection locations make possible the preparation of chair disassembled components which can be packed together without problems in a relatively small box or the like, yet which can be manually assembled together without tools into a completed chair structure which is reliable and stable. Such an assembled chair structure can also be subsequently disassembled into such chair components for storage, carrying or shipment, if desired.

The present chair structure thus overcomes the disadvantages and problems that are associated with the prior art chair structures and provides new features and advantages that were unknown to the prior art.

Other and further objects, purposes, features, advantages, embodiments and the like will be apparent to those skilled in the art from the present specification taken with the appended drawings and accompanying claims.

Brief Description of the Drawings

In the drawings:

FIG. 9 is a perspective view of another embodiment of an assembled infant bounce type chair structure of this invention with an illustrative seat covering being shown fragmentarily;

FIG. 10 is a plan view of the chair structure of FIG. 9 with an illustrative seat covering being shown fragmentarily;

FIG. 11 is an enlarged fragmentary side elevational view of the frame of the chair structure of FIG. 9 taken from the right side (relative to a viewer located in front of the chair structure);

FIG. 12 is a fragmentary top plan view taken in the region XII—XII of FIG. 11 showing the connectors in association with the portions of each of the upper frame member, the leg support frame member, and the toy bar;

FIG. 13 is a fragmentary top plan view of the rear right side corner of the lower frame member of the chair structure of FIG. 9, some parts thereof being shown in longitudinal section;

FIG. 14 is a fragmentary transverse sectional view perpendicularly taken through one side leg of the upper frame member along the line XIV—XIV of FIG. 9; and FIG. 15 is a view similar to FIG. 14, but taken along the line XV—XV of FIG. 9.

DETAILED DESCRIPTION

Figure 1:
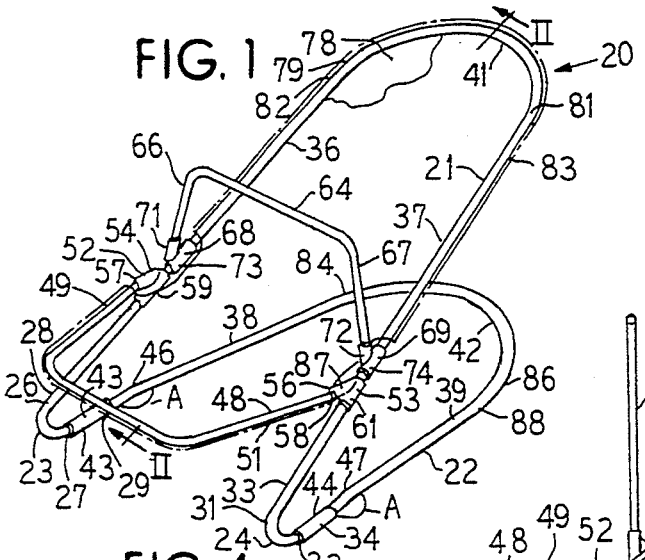
FIG. 1 is a perspective view of one embodiment of an assembled infant bouncer type chair structure of this invention with an illustrative seat covering being shown fragmentarily and in phantom.

Referring to FIGS. 1–8, there is an embodiment 20 of an assembled infant chair structure of this invention. Embodiment 20 incorporates an upper, U-shaped, peripherally extending (relative to the chair structure 20), spatially transversely generally flattened, rearwardly upwardly inclined frame member 21 that here conveniently and preferably is comprised of a cross-sectionally circular tube of formed metal or the like. Embodiment 20 also incorporates a lower, U-shaped, peripherally extending, floor engagable frame member 22 that is similarly comprised. The upper frame member 21 is located in generally vertically disposed, angularly oriented, spaced relationship to the lower frame member 22. The longitudinal center line of the lower frame member 22 is located in generally vertically disposed spaced, coplanar relationship to the longitudinal center line of the upper frame member 21 as shown by the line 25—25 in FIG. 3 which represents the (hypothetical) plane passing vertically through such center lines.

Embodiment 20 further incorporates a pair of U-shaped, transversely spaced, generally horizontally opposed (relative to each other) interconnecting frame segments 23 and 24. In embodiment 20, U-shaped segment 23 is joined at its respective opposite terminal leg ends 26 and 27 with respective leg ends 28 and 29, where leg end 28 is one end of upper frame member 21, leg end 29 is one end of lower frame member 22, and end 29 is in adjacent, vertically spaced relationship to end 28.

Similarly, segment 24 joins at its respective opposite leg ends 31 and 32 with respective leg ends 33 and 34, where leg end 33 is the end of upper frame member 21 that is opposed to end 28, where leg end 34 is the end of lower frame member 22 that is opposed to end 29, and where end 34 is in adjacent, vertically spaced relationship to end 33.

The exact location of each of the individual leg ends 26, 27, 28, 29, 31, 32, 33 and 34 cannot be precisely defined since these ends may not in fact individually exist as ends, but rather approximate leg end locations are identified herein for convenience in describing and identifying portions of the frame components of the embodiment 20, as those skilled in the art will appreciate.

Various segments 23 and 24 are preferably (and as shown) characteristically arcuate so that neither segment 23 nor 24 need have at its respective opposite ends any terminal straight leg section. However, each of the upper and lower frame members 21 and 22 is regarded as having a pair of terminal leg sections radiating from its respective arcuate rear periphery or section 41 and 42. In upper frame member 21, these leg sections are identified as 36 and 37, respectively, and, in lower frame member 22, these leg sections are identified as 38 and 39, respectively, as shown, for example, in FIG. 1. These respective leg sections of a pair thereof are symmetrical and can be straight or curved, or divergent relative to one another (as in embodiment 20), or otherwise as desired. However, preferably, the leg sections adjacent the individual ends 26, 27, 28, 29, 31, 32, 33 and 34 are straight for purposes of association with telescoping sleeve-type connectors, as described herein.

If the main frame that is comprised of upper and lower frame members 21 and 22 and also their interconnecting segments 23 and 24 were formed as a one-piece integral construction, the resulting frame structure would tend to be too bulky for practical storage, shipment, warehousing, stock room holding, and the like. Therefore, this combination of frame members 21 and 22 and segments 23 and 24 is fabricated so as to be in at least two separate sections which are interjoinable or interconnectable preferably manually and without any need for tools.

A present preference is to form separately the frame members 21 and 22 of metal, more preferably steel-type rod stock, and to integrally include the segments 23 and 24 with the terminal ends of either one of the frame members 21 and 22. An arrangement where the upper frame member 21 is continuous and integral at its opposite ends 28 and 33 with the segments 23 and 24, respectively, is shown in embodiment 20. Here, each of the lower leg ends 27 and 32 of each respective segment 23 and 24 includes an adjacent short straight terminal portion which is slightly upturned, each to a similar extent (relative to the other thereof). Each of the straight portions is fitted with a slidably engagable sleeve 43 and 44 that extends beyond the segment ends 27 and 32.

The lower frame member 22 is configured so that the opposite ends 29 and 34 of the lower frame member 22 are downturned at a slight angle commencing at transversely opposed locations 46 and 47. Locations 46 and 47 are situated in the respective leg sections 38 and 39. Locations 46 and 47 are also in adjacent, spaced relationship to their respective ends 29 and 34. The location and the bend angle at each of the locations 46 and 47 is variable. A present preference is to employ a bend angle that is in the range of about 5° to about 20°, and this angle is also chosen so as to bring the ends 29 and 34 of lower frame member 22 into a desired, alignable, opposed parallel relationship with the straight ends 27 and 32 of segments 23 and 24. Thus, the open end of each sleeve 43 and 44 is slidably engagable with each end 29 and 34.

Figure 2:
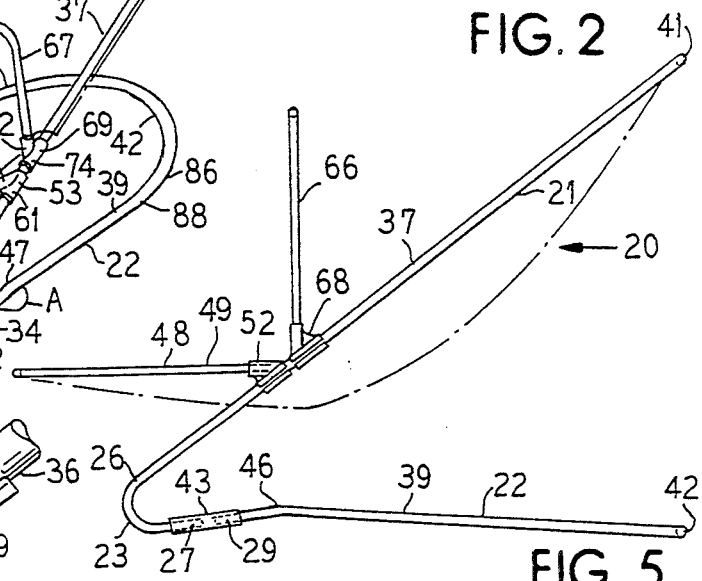
FIG. 2 is a vertical sectional view of the chair structure of FIG. 1 taken along the line II—II (a center line) with an illustrative seat covering being shown in phantom.
Figure 4:
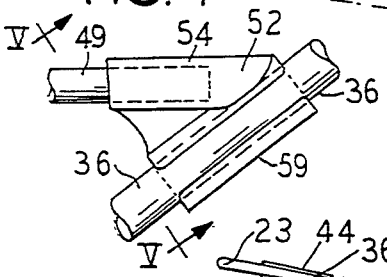
FIG. 4 is an enlarged, fragmentary, side elevational view of the lower connector body shown in FIG. 2 for joining one end of the leg support frame member to a portion of the upper frame member.
Figure 3:
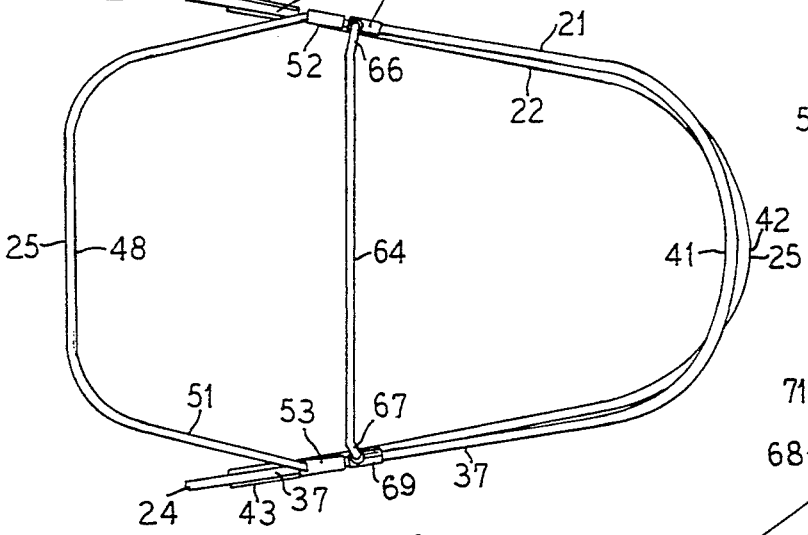
FIG. 3 is a top plan view of the chair frame structure of FIG. 1.
Figure 5:
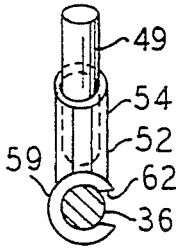
FIG. 5 is an enlarged, fragmentary, vertical front sectional view generally taken along the line V—V of FIG. 4.
Figure 6:
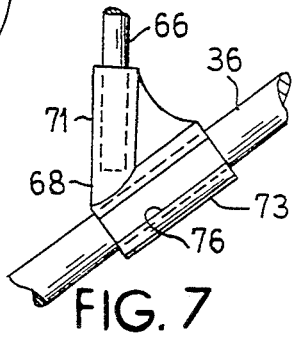
FIG. 6 is an enlarged, fragmentary, side elevational view of the upper connector body shown in FIG. 2 for joining one end of a toy bar to a portion of one leg of the upper frame member.

In embodiment 20 as shown, the ends 27, 32, 29, and 34 are actually hidden from direct viewability by the associated sleeves 43 and 44, but, see, for example, the dotted phantom lines in sleeve 43 shown in FIG. 2. In FIG. 2, these ends 27 and 29 are generally indicated by these numerals for reference and present description purposes as indicated above. Each sleeve 43 and 44 can be alternatively preliminary associated with during chair 20 manufacture with a different end 29 and 34 if desired.

Also, each sleeve 43 and 44 can be preliminarily conventionally secured by an adhesive, welding, crimping, staking, force-fitting, or like securing means to its associated end during chair manufacture to avoid sleeve loss and to assure a fixed sleeve position relative to its first associated end. While the sleeves 43 and 44 can be provided with a curvature which adapts them to fit slidably and telescopically over curved terminal end portions, such as could optionally be associated with the segments 23 and 24, it is presently preferred to use sleeves 43 and 44 which are straight. Thus, the end portion of the respective segments 23 and 24 which is associated with a sleeve 43 or 44 preferably extends a short, straight distance, as indicated. Various arrangements for sleeve connectors can be used.

By thus inclining the terminal end portions of the legs 38 and 39 of bottom frame member 22, the chair structure 20 becomes floor engaging at three locations: One floor engaging location being under each segment 23 and 24, and the third location being under the arcuate region 42. Thus, a stable positioning of chair structure 20 on an irregular floor surface is enhanced, as is desirable for controlled and safe usage and bouncing action of the chair structure 20. However, such a bend at locations 46 and 47 in the bottom U-shaped frame member 22 is optional. Frame member 22 can be, if desired, spatially transversely flattened (or planar), or frame member 22 can have some other spatial configuration, if desired.

A break (i.e., discontinuity or separation) between respective ends of segments 23 and 24 and frame member 21 or 22 can be alternatively located, if desired, instead of being as shown and described for embodiment 20. For example, instead of such a break being between adjacent ends 27/29 and 32/34, a break (not shown) can be formed between adjacent ends 26/28 and 31/33, and these latter respective ends can be similarly coupled together by use of sleeves 43 and 44.

However, it is presently greatly preferred not to put a break both between adjacent ends 27/29 and 32/34 and also between adjacent end 26/28 and 31/33 (which ends could then each associate with sleeves). Such an arrangement could create the unsafe possibility of frame collapse due to a sidewards torque effect that occurs when an assembled chair with both such upper and lower break pairs is in use and under load (as from an infant).

If desired, a break (not shown) can be positioned between the ends 79 and 81, periphery 41, and the upper adjacent ends of 82 and 83 of each leg section 36 and 37, respectively, and the opposed respective ends 79/82 and 81/83 can be interconnected by sleeves (not shown). Also, if desired, a break (not shown) can be positioned between the ends 84 and 86 of periphery 42 and the rear adjacent ends 87 and 88 of each leg portion 38 and 39, respectively, and such opposed respective ends 84/87 and 86/88 can be interconnected by sleeves (not shown).

Chair structure 20 also incorporates, preferably and as shown, a U-shaped, peripherally extending (relative to chair structure 20), spatially transversely flattened, forwardly projecting leg support frame member 48. Each opposed leg end 49 and 51 of the leg support frame member 48 is positioned in adjacent, almost abutting relationship to a different one of the legs 36 and 37 of the upper frame member 21.

To connect leg support frame member 48 to upper frame member 21 at a chosen pair of leg end 49 and 51 abutments, a first pair of generally transversely opposed (relative to chair 20) V-type connectors 52 and 53 is provided. Each connector 52 and 53 is unitarily formed and is conveniently comprised of molded plastic or metal. Each connector 52 and 53 incorporates (as illustratively shown in FIGS. 4 and 5) a tubular portion 54 and 56 that terminates in an open end 57 and 58, respectively, and into which one of the leg ends 49 or 51 is slidably insertable telescopically. Each connector 52 and 53 also incorporates a sleeve portion 59 and 61 that has a longitudinally extending slot 63 defined through and along a side thereof. While, in the embodiments shown, the slots 63 are disposed approximately at 90° relative to the longitudinal axis (not shown) of tubular portions 54 and 56 (which is a presently preferred arrangement), these slots 63 can also and alternatively be disposed at approximately 180° relative to the axis to tubular portions 54 and 56, if desired. Also, in the embodiment 20 shown, the slots 63 are disposed so as to be located on the outside of chair structure 20 as now preferred and shown.

Thus, the connectors 52 and 53 in embodiment 90 preferably are, in effect, mirror images of one another with the respective axis of each tubular portion 54 and 56 being positioned at an acute angle relative to the respective individual axes (not shown) of the sleeve portions 59 and 61. The size of this angle is variable, but a present preference is to employ an angle that is in the range of about 20° to about 60° with respect to horizontal, but larger and smaller angles could be used, if desired. A presently more preferred angle is in the range of about 25° to about 35°.

It is preferred for the leg support frame member 48 to be angularly inclined relative to the inclination angle of the upper frame member 21. Thus, commonly, the frame member 48 is inclined with respect to the horizontal at an angle ranging from about minus 15° to about plus 40°. A presently more preferred angle of inclination for leg support frame member 48 is in the range of about 15° to about 25°. The angular relationships between the axes of tubular portions 54 and 56 and the axes of sleeve portions 59 and 61 are chosen accordingly.

Various connectors of the V-type can be employed. For a given chair structure 90, one connector pair 52 and 53 can be removed and replaced by another connector pair for purposes of changing the angle of inclination of the leg support frame member 48 relative to the upper frame member 21, if desired.

Alternatively, is desired, the connectors 52 and 53 can be constructed so that they are identical to one another by making the longitudinal side slots 63 identically correspond on each connector 52 and 53 (so that these connectors are then not mirror images of one another). Thus, such slot can be formed on the same side of all connectors (for example, at 90° or 180° relative to the sleeve portion).

In general, each connector 52 and 53 is formed and configured so that the sleeve portion 59 and 61 thereof is extendable circumferentially over and around a portion of leg 36 and 37 when mounted thereover through the slot 63. Preferably, the connectors 52 and 53 are each comprised of a resilient material, such as a somewhat elastomeric but relatively rigid thermoplastic (such as polypropylene or other polyolefin, including homopolymers, copolymers, polyblends and the like) so that the slots 63 can be expanded during mounting over the legs 36 and 37 and then contract to securely grip the associated respective adjacent circumferential portions of legs 36 and 37. However, when the connectors 52 and 53 are formed of a rigid and shape retentive material, such as a deformable metal or the like, the connectors can be slot-expanded (bent open), mounted and then compressed (bent shut) against the associated legs 36 and 37. It is now preferred for the connectors 52 and 53 to be installed at a predetermined location on respective legs 36 and 37 at the time of chair manufacture.

Optionally but preferably, the chair structure 20 is additionally provided with a U-shaped, upwardly arching so-called toy bar 54. Each opposed leg end 66 and 67 of the toy bar 64 is located in adjacent relationship to a different respective one of the legs 36 and 37 of the upper frame member 21. Also, the toy bar 64 is located along each leg 36 and 37 so as to be above the location of the connectors 52 and 53.

To connect the toy bar 64 to the upper frame member 21, a second pair of V-type connectors 68 and 69 is provided. The connectors 68 and 69 are similar in construction and in function to the connectors 52 and 53. Thus, connectors 68 and 69 are provided with tubular portions 71 and 72 and with integrally associated sleeve portions 73 and 74. The sleeve portions 73 and 74 incorporate slots 76 and 77, respectively (see FIG. 6).

The angular relationship between the tubular portions 71 and 72 and the sleeve portions 73 and 74 is such that, for the chair structure 20, the toy bar 64 preferably projects vertically upwardly, although other upwardly projecting angles can be used, if desired. Typically, the angular relationship between the respective tubular portions 71 and 72 and their associated sleeve portions 73 and 74 falls in the angle range of about 20° to about 60°, although other angles can be used, if desired.

Figure 8:
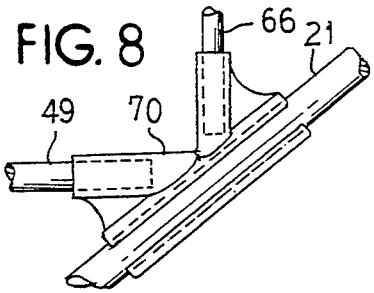
FIG. 8 is an enlarged fragmentary side elevational view of an alternative unitary connector body which incorporates the two connector bodies as shown in FIGS. 4 through 6, this alternative connector body being locatable along one lower leg portion of the upper frame member.
Figure 7:
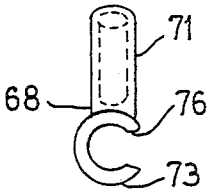
FIG. 7 is an enlarged, front elevational view of a connector body shown in FIG. 6 (with chair frame members removed)

By using bar or tube stock or the like of common diameter for each of the various frame members, one can employ, if desired, a single type of connector structure for each of the connectors 52, 53, 68 and 69, particularly when the same inclination angle between the connector tubular portion and sleeve portion is used for all connecting locations. Also, connectors 52 and 53, and connectors 68 and 69, respectively, can be formed as a single unitary connector structure such as illustrated in FIG. 8. Here, in effect, the indicated respective connector pairs are abuttingly engaged so that their sleeve portions are coaxial.

The upper frame member 21 and the leg frame 48 can be covered with a conventional fabric material 78.

Referring to FIGS. 9–15, there is seen another embodiment 90 of an assembled infant chair structure of this invention. Embodiment 90 incorporates in its main frame an upper, U-shaped, peripherally extending (relative to the chair structure 90), spatially transversely generally flattened, rearwardly upwardly inclined frame member 91 that here is conveniently and preferably comprised both of a cross-sectionally circular tube of formed metal or the like, and also a cross-sectionally circular rod of formed metal or the like as hereinafter explained. Embodiment 90 also incorporates a lower, U-shaped, peripherally extending, floor engagable frame member 92 whose structure is likewise comprised both of a cross-sectionally circular rod and a cross-sectionally circular tube, both comprised of formed metal or the like, as hereinafter described. The upper frame member 91 is located in generally vertically disposed, angularly inclined, spaced relationship to the lower frame member 92. As in the case of embodiment 20, in embodiment 90, the longitudinal center line of the lower frame member 92 is located in generally vertically disposed, spaced, coplanar relationship to the longitudinal center line of the upper frame member 91 as illustrated by the line 100—100 in FIG. 10 which represents a (hypothetical) center plane passing vertically through such center lines.

Embodiment 90 further incorporates a pair of U-shaped, transversely spaced, generally horizontally opposed (relative to each other) interconnecting frame segments 93 and 94. In embodiment 90, segment 93 is integrally joined at its respective opposite leg ends 96 and 97 with respective leg ends 98 and 99, where leg end 98 is one end of upper frame member 91, where leg end 99 is one end of lower frame member 92, and where end 99 is in adjacent, vertically spaced relationship to end 98. Similarly, segment 94 joins at its respective opposite leg ends 31 and 32 with respective leg ends 101 and 102 with respective leg ends 103 and 104, where leg end 103 is the end of upper frame member 91 that is opposed to end 98, where leg end 104 is the end of lower frame member 92 that is opposed to end 99, and end 104 is in adjacent, vertically spaced relationship to end 103.

The exact location of each of the individual leg ends 96, 97, 98, 99, 101, 102, 103 and 104 cannot be precisely defined since these ends may not in fact individually exist, but rather only approximate leg end locations are identified herein for convenience in describing and identifying portions of the frame components of the embodiment 90, as those skilled in the art will appreciate.

Segments 93 and 94 are preferably (and as shown) characteristically arcuate so that neither segment 93 or 94 need have at its respective opposite ends any terminal straight leg section. However, each of the upper and lower frame members 91 and 92 is regarded as having a pair of side legs radiating from its rear end peripheral connecting sections 111 and 112, respectively. In upper frame member 91, these leg sections are identified as 106 and 107, respectively, and, in lower frame member 92, these leg sections are identified as 108 and 109, respectively, as shown in FIGS. 9 and 10. These respective leg sections of a pair thereof relative to each other are symmetrical and can have various configurations (as in embodiment 20). However, preferably, the respective leg sections adjacent the individual ends 96, 97, 98, 99, 101, 102, 103 and 104 are straight.

The main frame which is comprised of upper and lower frame members 91 and 92 and their interconnecting segments 93 and 94 is fabricated so as to be in at least two separate sections which are interjoinable or interconnectable preferably manually and without any need for tools.

A present preference is to form the lower portion 106A and 107A of each leg section 106 and 107, respectively, in the upper frame member 91 of steel-type rod stock, and to integrally associate such portions 106A and 107A with the segments 93 and 94 and the entire leg sections 108 and 109 of the lower frame member 92, respectively, thereby achieving two formed rod members. The upper portion 106B and 107B of each leg section 106 and 107, respectively, and the connecting end section 111 in the upper frame member 91 are comprised of a single U-shaped formed tube and the tube opposite ends 113 and 114 are each provided with an inside diameter which is slidably extendable over the upper ends 116 (see illustrative FIG. 11) of each of the lower portions 106A and 107A.

In the preferred embodiment shown, the extent of travel of the tube ends 113 and 114 over their respective rod ends 116 is limited by collar 118 and 119, respectively, which are affixed adjacent the rod end 116 of each rod 106A and 107A by an adhesive, welding, soldering, swaging or the like, as desired.

Alternatively, the tube is chosen to have an inside diameter which is about equal to, or even smaller than, the outside diameter of the rods 106A and 107A. The tube inside diameter adjacent each end thereof is then enlarged sufficiently to receive slidably the rods 106A and 107A therein for a predetermined distance. Any convenient sleeve type of interconnection means can be employed.

Preferably, and as shown, the rear end portion 109A (as shown, for example, in FIG. 13) of each of the lower leg sections 108 and 109 is inturned so as to be in opposed relationship to each other. These end portions 109A are each slidably interconnectable with a different respective opposite end region of a transversely extending elongated straight sleeve 112 whose inside diameter is such that the respective opposed sleeve end portions 109A are each slidably engagable therewith. Stability of chair 90 is augmented by a straight projection for the rear connecting portion of lower frame member 92.

The lower frame member 92 is also preferably configured so that the opposite ends 99 and 104 are each downturned at a slight angle B (see FIG. 9) commencing at each of the transversely opposed bend locations 122 and 123 located in the respective leg sections 108 and 109. Locations 122 and 123 are in adjacent, spaced relationship to each other and to their respective ends 99 and 104. The position of the locations 122 and 123 can be varied as can the bend angle B. A present preference is to employ a bend angle B that is similar to the corresponding angle that is employed in the embodiment 20.

By thus inclining the terminal end portions of the legs 108 and 109 of bottom frame member 92, the chair structure 90 becomes floor engaging at three general locations. One floor engaging location is under each leg end 99 and 104, and the third location is under sleeve 112. Thus, a stable positioning of chair structure 20 on a somewhat irregular floor surface is enhanced, as is desirable for controlled and safe usage and bouncing action of the chair structure 90.

To cushion all floor engaging locations relative to the floor, cushioning means is preferably provided, such as by, for example, and as shown in FIGS. 9 and 13, elastomeric rings 124 which are slidably extended over each of the leg sections 108 and 109 so as to be adjacent leg ends 99 and 104 and also over each opposite end of the sleeve 112.

Thus, in embodiment 90, the main frame structure can be disassembled into parts for storage, shipment and reassembly, as desired. The parts can be considered to comprise the (a) tubular upper portion of the upper frame member 91, (b) each of the combined lower legs 106A, segment 93 and lower legs 108 and the combined lower leg 107A, segment 94, and lower leg 109, and (c) the sleeve 112.

Chair structure 90 also incorporates a U-shaped, peripherally extending (relative to chair structure 90), spatially transversely flattened, forwardly projecting leg support frame member 126. Frame member 126 has a pair of opposed leg sections 127 and 128 and an integral interconnecting section 129 that preferably is straight in its central region.

It is now preferred to connect leg support frame member 126 to respective upper frame member 91 at locations that are below the collars 118 and 119. To make this connection, a first pair of V-type connectors 131 and 132 is provided which are located in transversely opposed relationship to each other in chair 90. Each connector 131 and 132 is structurally similar to connectors 52 and 53 in chair embodiment 20. Each connector 131 and 132 incorporates a tubular portion 133 and an integrally formed sleeve portion 134 with the portion 133 and the portion 134 interconnected by a web 135 (as shown in, for example, FIG. 11). The longitudinal slot 136 in each connector 131 and 132 is located in its connector 131 and 132 so as to be on the lateral outside edge thereof when the connector is connected with leg sections 106A and 107A, respectively. Thus, the connectors 131 and 132 in embodiment 90 are, in effect, mirror images of one another with the respective axis (not shown) of each tubular portion 133 being positioned at an acute angle relative to the axis of each sleeve portion 134. Various V-type connector arrangements can be used.

It is preferred for the leg support frame member 126 to be angularly inclined relative to the inclination angle of the upper frame member 91 (as in the leg support frame member 48 in embodiment 20). The angular relationships between the upper frame member 91 and the leg support frame member 91 can be as above described in embodiment 20. The V-type of connector pairs for a given chair structure 90 can be structured so that, if desired, one connector pair, such as connectors 131 and 132, can be removed and replaced by another connector pair (not shown) for purposes of changing the angle of inclination of the leg support frame member 48 relative to the upper frame member 21. However, it is presently preferred to connect connectors 131 and 132 with the ends of leg sections 127 and 128 of leg support frame member 126 with an adhesive 130 (see FIGS. 11 and 12 where connector 132 is shown) or the like at the time of chair manufacture particularly in order to reduce the total number of separate components of a disassembled chair structure 90 and so that assembly and disassembly of chair structure 90 is made as simple as possible for usage.

Preferably, the connectors 131 and 132 are each comprised of a resilient material, such as a molded elastomeric plastic, so that each slot 136 can be expanded during mounting over the legs 106 and 107 and then contracted to securely grip the associated respective adjacent circumferential portions of legs 106 and 107.

Optionally but preferably, the chair structure 90 is additionally provided with a U-shaped, upwardly arching so-called toy bar 137. Toy bar 137 is generally U-shaped and preferably comprised of steel like rod stock. It has a pair of opposed leg sections 138 and 139 that are integrally interconnected together at their upper ends by a generally straight connecting section 141. Each lower terminal end of opposed leg section 138 and 139 of the toy bar 137 is located in adjacent relationship to a different respective one of the legs 106A and 107B of the upper frame member 91. Also, toy bar 137 is preferably located along each leg 106 and 107 so as to be above and preferably adjacent to the location of the connectors 131 and 132 and below the location of the collars 118 and 119.

To connect the toy bar 137 to the upper frame member 91, a second pair of connectors 142 and 143 is provided. The connectors 142 and 143 are similar in construction and in function to the connectors 68 and 69 in embodiment 20, and each is provided with a tubular portion 144, an integrally associated sleeve portion 146 and a web portion 145. Each sleeve portion 146 incorporates a slots 147 (see FIG. 11). The angular relationship between the tubular portions 144 and the sleeve portions 146 is preferably such that, for the chair structure 90, the toy bar 137 preferably projects generally vertically upwardly when each of the legs 138 and 139 is bent slightly at a location above and preferably adjacent to its associated connector 142 and 143, respectively, as shown, for example, in FIGS. 14 and 15. Other upwardly projecting angles can be used, if desired.

The angular relationship between the respective tubular portion 144 and their associated sleeve portion 146 in a connector 142 and 143 can be as described in reference connectors 68 and 69 in embodiment 20. The connectors 142 and 143 are preferably mirror images of each other. The slots 147 are positioned in the chair embodiment 90 so as to be along the inside of the respective associated leg sections 106A and 107B when the connectors 142 and 143 are mounted thereabout. Connectors 142 and 143 are preferably comprised of molded resilient plastic. Preferably the opposite ends of the toy bar 137 are each received and secured in the tubular portions 144 by an adhesive or the like during the chair manufacturing process to reduce the number of separatable chair components.

A feature of embodiment 90 is that the connector receiving region of each leg section 106A and 107A where each of the connectors 142 and 131 (on leg section 106A) and 143 and 132 (on leg section 107A) are received is isolated from adjacent upper and lower regions of each such leg section 106A and 107A. Thus, the collars 118 and 119 are provided about each of leg sections 106A and 107A, respectively, above the connector receiving region. Compound bends 151 and 152 are provided in each leg section 106A and 107A, respectively, below the connector receiving region as shown in, for example, FIGS. 10 and 11. The combination of the collars 118 and 119 with the bends 151 and 152 function coactively to restrain the connectors 142 and 131 and 143 and 132 from longitudinal sliding movements along their respective associated lower leg portions 106A and 107A beyond the connector receiving region.

The upper frame member 91 and the leg frame member 126 can be covered with a conventional fabric material 78'.

Other and further embodiments and arrangements for the chair structure of this invention will be apparent to those skilled in the art without departing from the spirit and scope of this invention.

What is claimed is:

1. An infant bouncer chair comprising:

an upper, generally U-configured, peripherally extending, rearwardly upwardly inclined frame member having a pair of opposed edge legs and a rear edge leg interconnecting section, each of said opposed edge legs having a forward end that is transversely spaced from the other thereof;

a lower, generally U-configured, peripherally extending, floor engagable frame member having a pair of opposed bottom legs and a rear bottom leg interconnecting section, each of said opposed bottom legs having a forward end that is transversely spaced from the other thereof;

a pair of U-configured, transversely spaced frame segments, each one having a pair of segment legs, each of said segment legs having a rearward end that is vertically spaced from the other, said rearward ends of each one of said frame segments being interconnected with a different vertically adjacent one of said forward ends of each of said upper and said lower frame members, whereby said upper frame member said lower frame member and said pair of frame segments combine to define a peripheral frame for said chair wherein said forward end of each said edge leg is in a terminally interconnected relationship with said rearward end of a different one of each of said segment legs thereby to define a pair of rearwardly upwardly inclined transversely opposed side legs in said peripheral frame;

a pair of discontinuities defined in said peripheral frame, each one of said discontinuities being in transversely spaced relationship relative to the other thereof, and a pair of sleeve retaining means, each one of said sleeve retaining means being positioned circumferentially about adjacent portions of a different one of said discontinuities and cooperating therewith for disengagably supporting said peripheral frame at each of one of said discontinuities;

two pairs of V-configured sleeve connector means, each individual sleeve connector means of each said pair thereof being unitarily formed and having:

two tubular intersecting sleeves, one said sleeve having open opposed ends and a longitudinal side slot extending between said opposed ends, and the second said sleeve having one open end and an opposite end that is abuttingly associated with said one sleeve adjacent one said open end thereof;

each said pair of sleeve connector means being egaged with a different one of said opposed side legs so that each individual said sleeve connector means of each said pair thereof being space from the other thereof along each said so engaged side leg whereby said one sleeve of each said sleeve connector means is extended about said so engaged side leg through said side slot and circumferentially so engages said so engaged side leg, and whereby, in each one of said so engaged sleeve connector pairs, one said sleeve connector means is upper most and the other thereof is lowermost, and said uppermost one of said sleeve connector means has said open end of said second sleeve thereof oriented upwards, while said lowermost one of said sleeve connector means has said open end of said second sleeve thereof oriented sidewards and longitudinally;

a generally U-shaped, peripherally extending forwardly projecting leg support frame member having a pair of opposed support legs and a forward support leg interconnecting section, each of said opposed support legs having a rearward end that is transversely spaced from the other, and each said rearward end is inserted into said open end of a different one of each of said lowermost second sleeves;

a generally U-shaped, upwardly arching toy bar having a pair of opposed bar side legs and an upper bar side leg interconnecting section, each of said opposed bar side legs having a downward end that is transversely spaced from the other, and each said downward end is inserted into said open end of a different one of each of said uppermost second sleeves; and a body supporting removable chair covering means for said leg support frame member and for adjoining portions of said upper frame member located above said sleeve connector means;

whereby decentralized connections are achieved between said opposed side legs and each of said leg support frame member and said toy bar.

2. The chair of claim 1 wherein, in said toy bar, said upper bar side leg interconnecting section includes a substantially straight portion that extends transversely over and across said upper frame member, and each of said opposed bar side legs is bent at a location adjacent to its associated said uppermost second sleeve so that each of said opposed bar side legs is substantially vertically oriented above each said associated uppermost second sleeve.

3. The chair of claim 1 wherein said lower frame member is provided with a plurality of cushioning means, there being one said cushioning means at each location of lower frame engagement with an underlying substantially level floor surface.

4. The chair of claim 1 wherein each one of said sleeve connector means is comprised of an integrally formed molded plastic body.

5. The chair of claim 1 wherein, on each one of said side legs, each individual said sleeve connector means of said so engaged pair of sleeve connector means abuts against and is unitary with the other individual said sleeve connector means of said so engaged pair of sleeve connector means.

6. The chair of claim 1 wherein at least one member of each of said two pairs of sleeve connector means is secured by adhesive means to preselected locations of said side legs.

7. The chair of claim 1 wherein each of said sleeve means is cylindrical.

8. The chair of claim 1 wherein said upper frame member, said lower frame member and said frame segments are comprised of rod material, each one of said sleeve connector means optionally includes fastening means fixing each one of said sleeve connector means to said so engaged side leg, and each said second sleeve of each said sleeve connector means is slidably telescopically engagable and disengagable with a different respective said end of each of said legs of said leg support frame member and said toy bar, whereby said peripheral frame, said leg support frame member, and said toy bar are disassemblable relative to each other for storage and shipment yet are reassemblable.

9. The chair of claim 1 wherein:

(a) each of said discontinuities is defined in a different one of said opposed side legs, and (b) in said lower frame member, said pair of opposed bottom legs is comprised of rod material and said rear bottom leg interconnecting section is comprised of tube material, and each opposite end of said rear bottom leg interconnecting section is telescopically receivable over a rear end portion of a different one of each of said opposed bottom legs.

10. The chair of claim 9 wherein:

(a) said discontinuity in each of said opposed side legs is above said sleeve connector means; and (b) each of said opposed side legs is bent below said sleeve connector means;

so that said sleeve connector means are restrained from longitudinal sliding movements along their respective associated said side legs.

11. The chair of claim 9 wherein collar means is associated with each of said opposed side legs for limiting the extent of slidable engagement of lower ends of said upper frame member circumferentially over upper ends of said lower frame member.

* * * * *